US011244772B2

(12) United States Patent
Kojima et al.

(10) Patent No.: US 11,244,772 B2
(45) Date of Patent: Feb. 8, 2022

(54) FLAT CABLE AND METHOD OF MANUFACTURING FLAT CABLE

(71) Applicant: SUMITOMO ELECTRIC INDUSTRIES, LTD., Osaka (JP)

(72) Inventors: Chiaki Kojima, Tochigi (JP); Tatsuo Matsuda, Tochigi (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/972,197

(22) PCT Filed: Jun. 25, 2019

(86) PCT No.: PCT/JP2019/025184
§ 371 (c)(1),
(2) Date: Dec. 4, 2020

(87) PCT Pub. No.: WO2020/012952
PCT Pub. Date: Jan. 16, 2020

(65) Prior Publication Data

US 2021/0233680 A1 Jul. 29, 2021

(30) Foreign Application Priority Data

Jul. 11, 2018 (JP) ..... JP2018-131852

(51) Int. Cl.
*H01B 7/08* (2006.01)
*C25D 5/02* (2006.01)
(Continued)

(52) U.S. Cl.
CPC ..... *H01B 7/08* (2013.01); *C25D 5/02* (2013.01); *H01B 7/1805* (2013.01); *H01B 13/00* (2013.01); *H01B 13/0013* (2013.01); *H01B 13/06* (2013.01)

(58) Field of Classification Search
CPC ..... H01B 7/08
See application file for complete search history.

(56) References Cited

U.S. PATENT DOCUMENTS 6,020,559 A * 2/2000 Maeda ..... H01B 7/0838 174/117 F
2005/0252677 A1* 11/2005 Gagne ..... H01B 7/0869 174/117 F (Continued)

FOREIGN PATENT DOCUMENTS

JP S58-094708 6/1983
JP 2002-352631 12/2002

(Continued)

*Primary Examiner* — Chau N Nguyen
(74) *Attorney, Agent, or Firm* — IPUSA, PLLC

(57) ABSTRACT

A flat cable includes: a plurality of conductors arranged in parallel; an insulating layer formed, on first surfaces of the plurality of conductors and on second surfaces that are opposite surfaces of the first surfaces, along the plurality of conductors; an exposed portion where the first surfaces at end portions of the conductors are exposed to outside; and a reinforcement plate formed on the second surfaces opposite to the exposed portion. On the second surfaces opposite to the exposed portion, the reinforcement plate is directly formed on the conductors, and on the second surfaces opposite to the first surfaces that are in continuous with the exposed portion, the reinforcement plate is formed between the conductors and the insulating layer on the second surfaces.

13 Claims, 10 Drawing Sheets

(51) Int. Cl.

| | |
|---|---|
| ***H01B 7/18*** | (2006.01) |
| ***H01B 13/00*** | (2006.01) |
| *H01B 13/06* | (2006.01) |

(56) References Cited

U.S. PATENT DOCUMENTS

| | | | | |
|---|---|---|---|---|
| 2005/0252678 | A1* | 11/2005 | Lee | H01B 7/0009 174/117 F |
| 2017/0207002 | A1* | 7/2017 | Kim | H01B 13/06 |

FOREIGN PATENT DOCUMENTS

| | | |
|---|---|---|
| JP | 2011-165393 | 8/2011 |
| JP | 2011-198687 | * 10/2011 |
| JP | 2013-073693 | 4/2013 |
| JP | 2015-156258 | 8/2015 |
| JP | 2017-068984 | 4/2017 |
| JP | 2018-181775 | 11/2018 |

* cited by examiner

FLAT CABLE AND METHOD OF MANUFACTURING FLAT CABLE

TECHNICAL FIELD

The present disclosure relates to a flat cable and a method of manufacturing a flat cable.

The present application is based on and claims priority to Japanese Patent Application No. 2018-131852, filed on Jul. 11, 2018, the entire contents of the Japanese Patent Application being hereby incorporated herein by reference.

BACKGROUND ART

A flexible flat cable (FFC), which is a type of a flat cable, is used for space saving and easy connection in many fields such as AV equipment such as CD and DVD players, OA equipment such as copiers and printers, and internal wiring of other electronic/information equipment. Also, a shield flat cable is used because the noise effect increases when the signal frequency of equipment is high.

A flat cable includes a plurality of conductors arranged in parallel and an insulating layer attached on both parallel surfaces of the conductors such that both end portions of these conductors are exposed. An end portion of the flat cable functions as a terminal portion, and as disclosed in Patent Document 1, from the viewpoint of increasing the reliability of the electrical connection with a connector, a reinforcement plate is provided to have a predetermined strength or to gold plating is applied to prevent whiskers from occurring.

PRIOR ART DOCUMENT

Patent Document

[Patent Document 1] Japanese Laid-open Patent Publication No. 2015-156258

SUMMARY OF THE INVENTION

According to one aspect of the present disclosure, a flat cable includes: a plurality of conductors arranged in parallel; an insulating layer formed, on first surfaces of the plurality of conductors and on second surfaces that are opposite surfaces of the first surfaces, along the plurality of conductors; an exposed portion where the first surfaces at end portions of the conductors are exposed to outside; and a reinforcement plate formed on the second surfaces opposite to the exposed portion, wherein on the second surfaces opposite to the exposed portion, the reinforcement plate is directly formed on the conductors, and on the second surfaces opposite to the first surfaces that are in continuous with the exposed portion, the reinforcement plate is formed between the conductors and the insulating layer on the second surfaces.

Also, according to one aspect of the present disclosure, a method of manufacturing a flat cable including a plurality of conductors arranged in parallel;

an insulating layer formed, on first surfaces of the plurality of conductors and on second surfaces that are opposite surfaces of the first surfaces, along the plurality of conductors; an exposed portion where the first surfaces at end portions of the conductors are exposed to outside; and a reinforcement plate formed on the second surfaces opposite to the exposed portion, the method including: an attachment step of attaching, to the conductors, first insulating layers arranged via a first interval on the first surfaces, second insulating layers arranged via a second interval on the second surfaces at locations corresponding to locations between which the first interval is provided; and a reinforcement plate that is longer than the second interval; and a division step of dividing the reinforcement plate in a longitudinal direction of the conductors.

EMBODIMENT FOR CARRYING OUT THE INVENTION

Problem to be Solved by The Present Disclosure

In recent years, the need for high-speed transmission of signals has increased, and it is necessary to secure withstand voltage and high-frequency characteristics of flat cables. For this reason, a thick resin such as, for example, polyethylene, polypropylene, polyimide, polyethylene terephthalate, polyester, or polyphenylene sulfide is used as an insulating layer of a flat cable.

Figure 12:
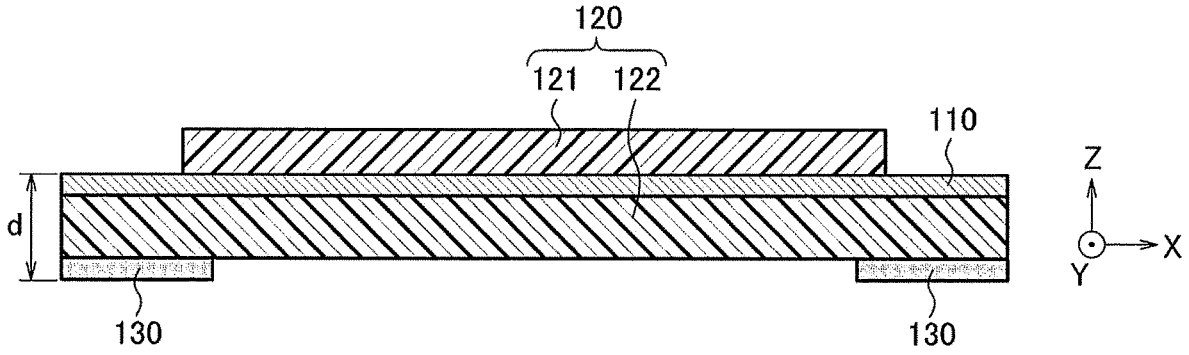
FIG. 12 is a cross-sectional view taken along a longitudinal direction of a portion of a flat-shaped conductor of a conventional flat cable.

For example, as illustrated in FIG. 12, in the case of a flat cable in which a first insulating layer 121 and a second insulating layer 122 are attached on both parallel surfaces a flat-shaped conductor 110 to form an insulating layer 120, when the second insulating layer 122 is thick and reinforcement plates 130 are provided on the lower surface side of the second insulating layer 122 to reinforce a terminal portion, the thickness d at the terminal portion becomes large, and a case may occur in which insertion into a connector is impossible. Also, when the reinforcement plates 130 are not provided, the terminal portion is too soft, and insertion of a connector is difficult.

Figure 13:
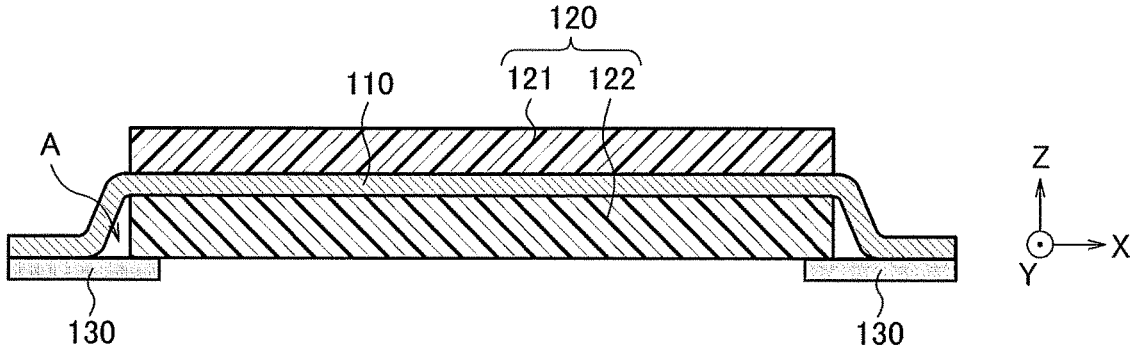
FIG. 13 is a cross-sectional view taken along a longitudinal direction of a portion of a flat-shaped conductor of a conventional flat cable.

Also, as illustrated in FIG. 13, in a case in which the end portions of a first insulating layer 121 and a second insulating layer 122 are removed, reinforcement plates 130 are provided on the lower surface side of the second insulating layer 122, and the reinforcement plates 130 are attached to a flat-shaped conductor 110, the thickness of the terminal portion can be determined to be a predetermined thickness depending on the thickness of the reinforcement plates 130. However, because the second insulating layer 122 is thick, there are large gaps A between the flat-shaped conductor 110 and the reinforcement plates 130, and the flat-shaped conductor 110 may peel off from the reinforcement plates 130. Further, when the exposed surface of the flat-shaped conductor 110 is gold-plated, there is a problem that the gold plating liquid remains in the gaps A, and there is a possibility that the gold plating liquid permeates between the flat-shaped conductor 110 and the insulating layer 120 to cause corrosion due to the gold plating liquid.

In view of the above, the present disclosure has an object to provide a flat cable and a method of manufacturing the same that enable to easily adjust the thickness of a terminal portion to be electrically connected to a connector and to enable to obtain a sufficient terminal strength without entrance of a gold plating liquid into an interface between conductors and an insulating layer in a case of performing gold-plating.

Effect of The Present Disclosure

According to the present disclosure, it is possible to provide a flat cable and a method of manufacturing the same that enable to easily adjust the thickness of a terminal portion to be electrically connected to a connector and to enable to obtain a sufficient terminal strength without entrance of a gold plating liquid into an interface between conductors and an insulating layer in a case of performing gold-plating.

Description of Embodiments of the Present Disclosure

First, embodiments of the present disclosure will be described by listing.

(1) A flat cable includes: a plurality of conductors arranged in parallel; an insulating layer formed, on first surfaces of the plurality of conductors and on second surfaces that are opposite surfaces of the first surfaces, along the plurality of conductors; an exposed portion where the first surfaces at end portions of the conductors are exposed to outside; and a reinforcement plate formed on the second surfaces opposite to the exposed portion, wherein on the second surfaces opposite to the exposed portion, the reinforcement plate is directly formed on the conductors, and on the second surfaces opposite to the first surfaces that are in continuous with the exposed portion, the reinforcement plate is formed between the conductors and the insulating layer on the second surfaces.

According to the configuration, it is possible to easily adjust the thickness of a terminal portion of the flat cable to be electrically connected to a connector and to obtain a sufficient terminal strength without entrance of a gold plating liquid into an interface between the conductors and the insulating layer in a case of performing gold-plating.

(2) In the flat cable, on the second surfaces opposite to the first surfaces that are in continuous with the exposed portion, the reinforcement plate may be directly formed on the conductors.

(3) In the flat cable, on the second surfaces opposite to the first surfaces that are in continuous with the exposed portion, the insulating layer may include a second insulating layer formed on the conductors and a third insulating layer formed on the second insulating layer, and the reinforcement plate may be formed between the second insulating layer and the third insulating layer.

(4) In the flat cable, the reinforcement plate may include a spacer at a position opposite to the exposed portion.

(5) In the flat cable, in a cross-section along a longitudinal direction of the conductors, the third insulating layer may cover an entire surface that is an opposite surface of a surface of the reinforcement plate facing the conductors.

(6) The flat cable may further include a shield layer that covers the insulating layer. According to the configuration, it is possible to obtain a shield flat cable that enables to easily adjust the thickness of a terminal portion of the flat cable to be electrically connected to a connector and enables to obtain a sufficient terminal strength without entrance of a gold plating liquid into an interface between the conductors and the insulating layer in a case of performing gold-plating.

(7) According to one aspect of the present disclosure, a method of manufacturing a flat cable including a plurality of conductors arranged in parallel; an insulating layer formed, on first surfaces of the plurality of conductors and on second surfaces that are opposite surfaces of the first surfaces, along the plurality of conductors; an exposed portion where the first surfaces at end portions of the conductors are exposed to outside; and a reinforcement plate formed on the second surfaces opposite to the exposed portion, the method comprising: an attachment step of attaching, to the conductors, first insulating layers arranged via a first interval on the first surfaces, second insulating layers arranged via a second interval on the second surfaces at locations corresponding to locations between which the first interval is provided; and a reinforcement plate that is longer than the second interval; and a division step of dividing the reinforcement plate in a longitudinal direction of the conductors.

According to the configuration, it is possible to locate the reinforcement plate inside the cable, it is possible to easily adjust the thickness of a terminal portion of the flat cable to be electrically connected to a connector, and it is possible to obtain a flat cable having a sufficient terminal strength without entrance of a gold plating liquid into an interface between the conductors and the insulating layer in a case of performing gold-plating.

(8) In the attachment step, the reinforcement plate may be attached to the second insulating layers and a third insulating layer may be arranged on the reinforcement plate on the second insulating layers. According to this configuration, by sandwiching part of the reinforcement plate with the insulating layers, part of the reinforcement plate can be separated from the conductors.

(9) The reinforcement plate may include a spacer member on a surface that is an opposite surface of a surface that is attached to the conductors at a position where the second interval is provided. According to this configuration, by changing the thickness of the spacer member, it is possible to easily adjust the thickness of a terminal portion to be electrically connected to a connector.

(10) The third insulating layer may entirely cover the reinforcement plate. According to this configuration, by sandwiching part of the reinforcement plate with the insulating layers, part of the reinforcement plate can be separated from the conductors.

(11) It is desirable that, on a surface of the reinforcement plate facing the conductors, and a surface at an end potion of the first insulating layer in contact with the first interval and facing the conductors, adhesive layers are provided in advance. Thereby, in a case of performing gold-plating, a gold plating liquid does not enter an interface between conductors and an insulating layer.

(12) It is desirable to further include a plating step of applying gold-plating to the exposed portion of the conductors. According to this configuration, it is possible to prevent whiskers from occurring.

Details of Embodiments of the Present Disclosure

In the following, specific examples of flat cables and manufacturing methods thereof according to the present disclosure will be described with reference to the drawings. In the following description, constituents with the same reference numerals may be treated as being similar in different drawings such that their descriptions may be omitted. It should be noted that the present disclosure is not limited to the following description and is intended to include all modifications within the scope of claims and equivalents thereof. The present disclosure also includes combinations of embodiments as desired so long as combinations are possible for a plurality of embodiments.

First Embodiment

Figure 1:
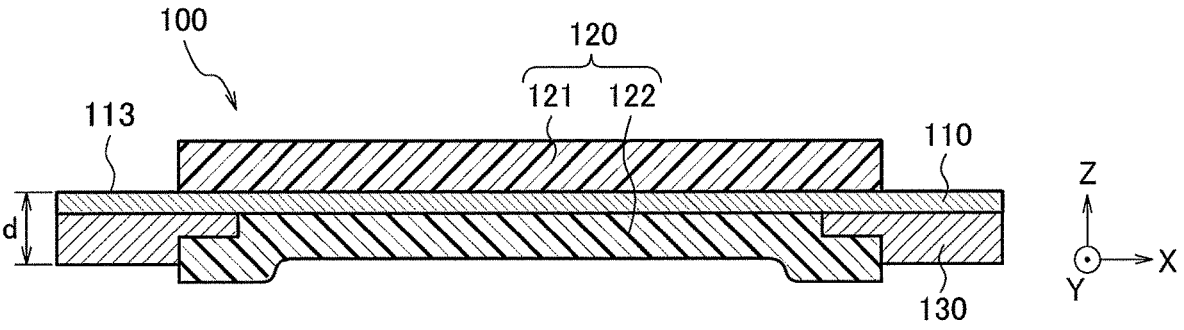
FIG. 1 is a cross-sectional view taken along a longitudinal direction of a portion of a flat-shaped conductor of a flat cable according to a first embodiment of the present disclosure.
Figure 2:
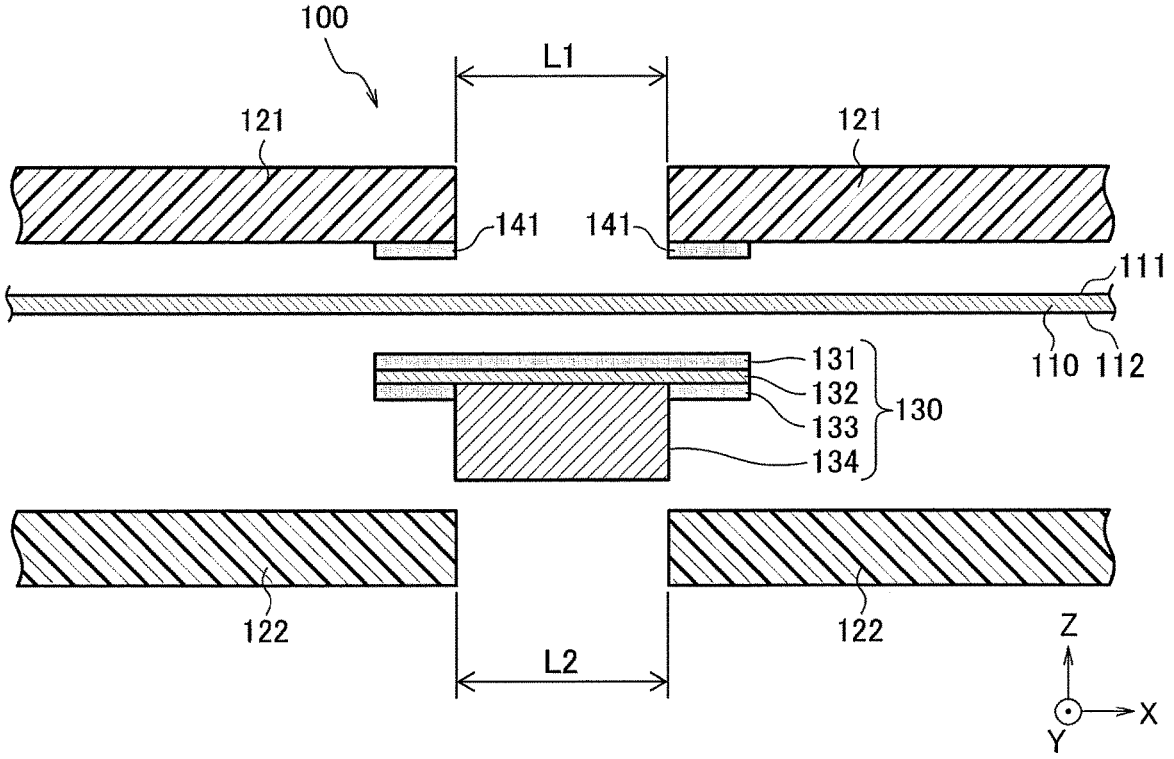
FIG. 2 is a cross-sectional view for describing a method of manufacturing a flat cable according to the first embodiment.
Figure 3:
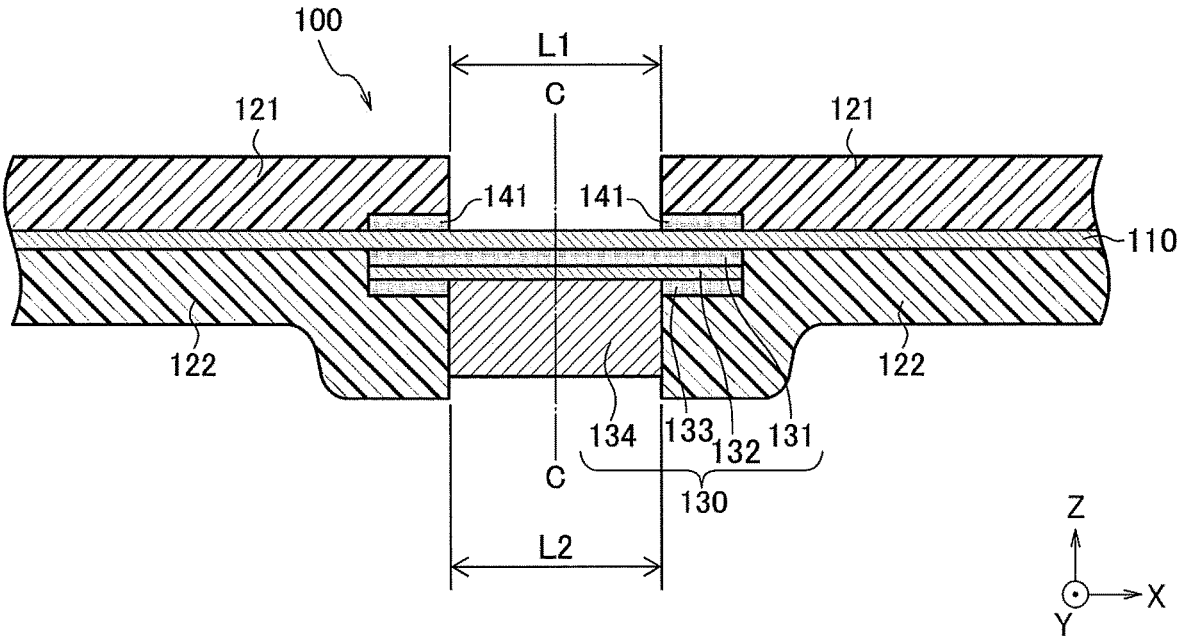
FIG. 3 is a cross-sectional view for describing the method of manufacturing the flat cable according to the first embodiment.
Figure 4:
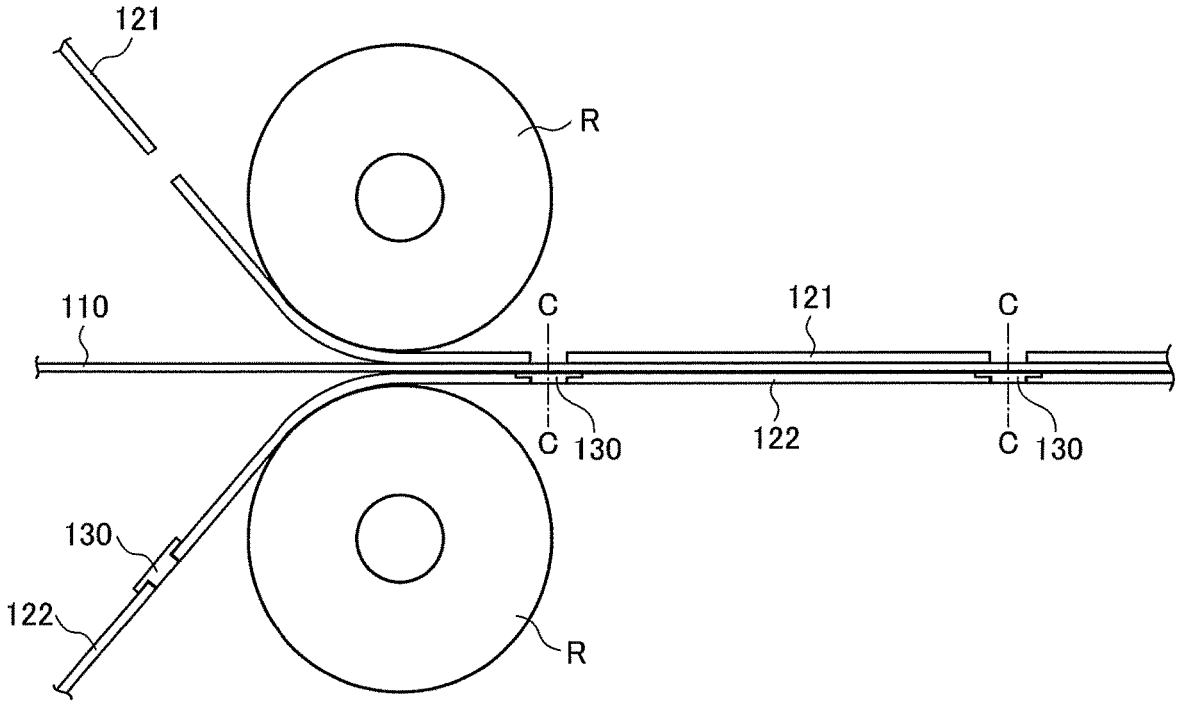
FIG. 4 is a schematic diagram illustrating the method of manufacturing the flat cable according to the first embodiment.
Figure 5:
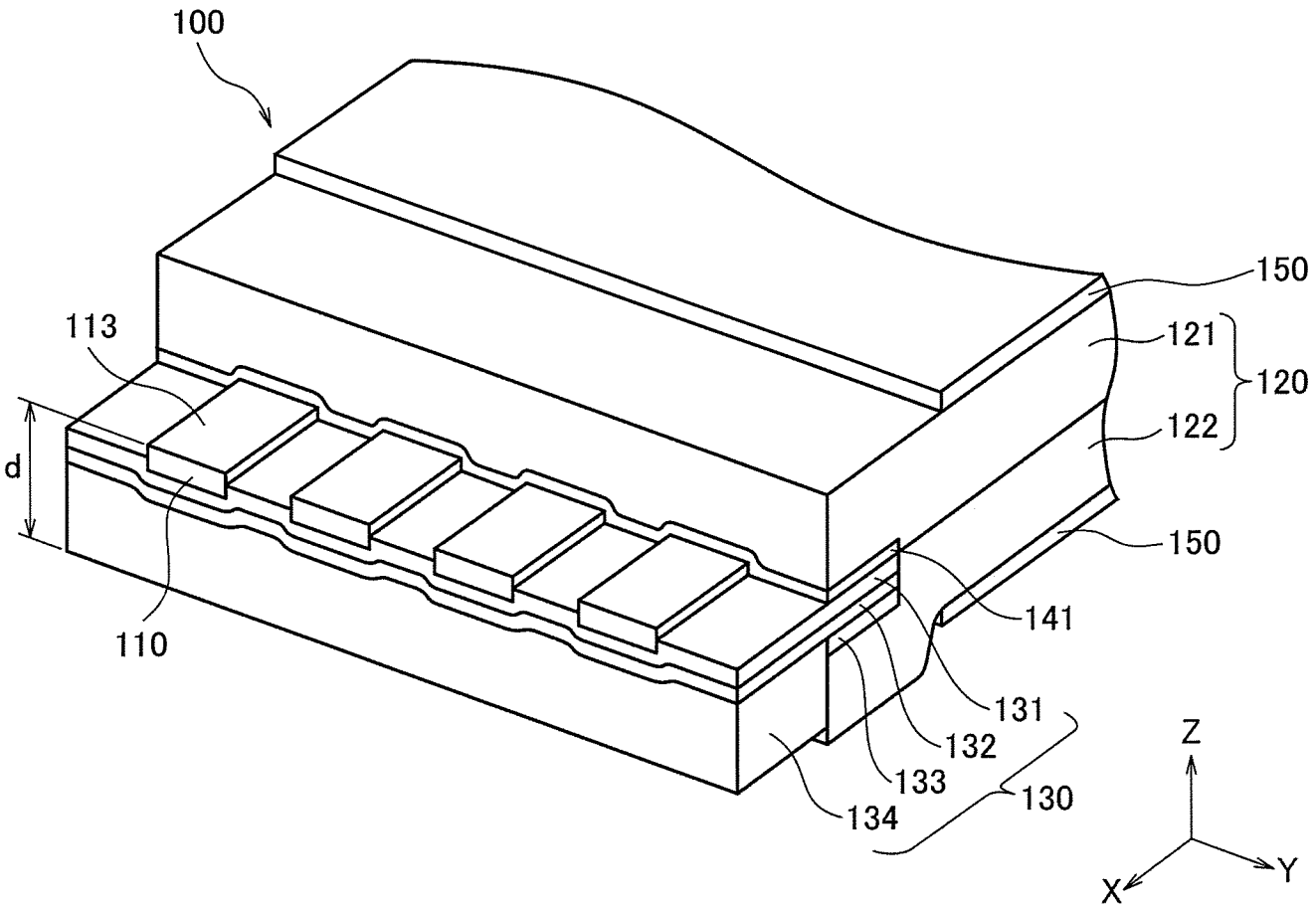
FIG. 5 is a perspective view of a terminal portion of the flat cable according to the first embodiment.

FIG. 1 is a cross-sectional view taken along a longitudinal direction of a portion of a flat-shaped conductor of a flat cable according to a first embodiment of the present disclosure, and FIG. 2 and FIG. 3 are cross-sectional views for describing a method of manufacturing a flat cable according to the first embodiment. Also, FIG. 4 is a schematic diagram illustrating the method of manufacturing the flat cable according to the first embodiment. FIG. 5 is a perspective view of a terminal portion of the flat cable according to the first embodiment.

As illustrated in FIG. 1 and FIG. 5, a flat cable 100 according to the present embodiment includes a plurality of flat-shaped conductors 110, an insulating layer 120 composed of a first insulating layer 121 and a second insulating layer 122, and reinforcement plates 130 provided at both end portions of the flat cable 100. Also, as illustrated in FIG. 5, at least one of the surfaces of the first insulating layer 121 and the second insulating layer 122 may be covered with a shield layer 150. It should be noted that in FIG. 1 to FIG. 4, the illustration of the shield layer 150 is omitted. Further, although not illustrated, the insulating layer 120 and the shield layer may be entirely covered with a protective layer. In the flat cable 100 according to the present embodiment, the reinforcement plates 130 support exposed portions of the flat-shaped conductors 110. Further, a portion of each reinforcement plate 130 (on the insulating layer 120 side relative to the exposed portion of the flat-shaped conductors 110) is bonded to the first insulating layer 121 located on the front surface side (on the positive side in the Z-axis direction, the same shall apply hereinafter) by an adhesive layer 141, and is bonded to the second insulating layer 122 located on the back surface side (on the negative side in the Z-axis direction, the same shall apply hereinafter) by a back surface side adhesive layer 133, as illustrated in FIG. 5.

Similarly, referring to the perspective view of the terminal portion of the flat cable 100 illustrated in FIG. 5, the flat cable 100 is configured such that the plurality of flat-shaped conductors 110 each having a flat shape in the cross section and extending in the X-axis direction are arranged in parallel in the Y-axis direction, and both surfaces in the direction (Z direction), which is perpendicular to the parallel surfaces (the XY plane), of the flat-shaped conductors 110 are sandwiched by the first insulating layer 121 on the front surface side and the second insulating layer 122 on the back surface side. The exposed portions of the flat-shaped conductors 110 without the insulating layer 120 serve as connection terminal portions for connecting with connectors. The flat-shaped conductors 110 have first surfaces 111 and second surfaces 112. The flat-shaped conductors 110 also have exposed surfaces 113.

The flat cable 100 includes the plurality of flat-shaped conductors 110 arranged in parallel; the insulating layer 120 formed, on the first surfaces 111 and the second surfaces 112 that are opposite surfaces of the first surfaces 111 of the plurality of flat-shaped conductors 110, along the plurality of flat-shaped conductors 110; exposed portions where the first surfaces 111 at the end portions of the flat-shaped conductors 110 are exposed to outside, and reinforcement plates 130 formed on the second surfaces 112 opposite to the exposed portions.

The flat-shaped conductors 110 are made of, for example, a metal such as copper foil or nickel-plated soft copper foil, for example, have a thickness of 12 μm to 100 μm, have a width of about 0.2 mm to 0.8 mm, and are arranged with an appropriate pitch P of 0.4 mm to 1.5 mm. The arrangement state of the flat-shaped conductors 110 is held between the first insulating layer 121 and the second insulating layer 122. Although the flat-shaped conductors 110 are used for signal transmission, predetermined flat-shaped conductors 110 may be grounded at the time of being connected to a connector terminal on a substrate side. Although four flat-shaped conductors 110 are described in FIG. 5, the number of flat-shaped conductors 110 is not limited to four.

The first insulating layer 121 and the second insulating layer 122 are layers for ensuring withstand voltage and high frequency characteristics of the flat cable 100 and are made of, for example, a resin such as, polyethylene, polypropylene, polyimide, polyethylene terephthalate, polyester, or polyphenylene sulfide. At portions of the first insulating layer 121 close to the exposed portions of the flat-shaped conductors 110, the adhesive layers 141 of material that enhances adhesion to the flat-shaped conductors 110 and the first insulating layer 121 are provided.

According to the present embodiment, the reinforcement plates 130 each has a configuration in which a front surface side adhesive layer 131 is provided on the entire front side surface of a resin layer 132, a spacer member 134 made of resin is provided at the center of the back surface side of the resin layer 132, and a back surface side adhesive layer 133 is provided at a portion other than the mounting surface of the spacer member 134. The reinforcement plates 130 have a convex shape in the X-Z cross section. For example, polypropylene is used as the resin layer 132, and as the front surface side adhesive layer 131, a material having good adhesion with the flat-shaped conductors 110 and the resin layer 132 is used. Also, a material having good adhesion with the insulating layer 120 is used as the back surface side adhesive layer 133. For example, polyethylene terephthalate is used as the material of the spacer member 134. As illustrated in FIG. 5, in the present embodiment, the thickness d of the terminal portion can be adjusted by changing the thickness of the spacer member 134.

On the second surfaces 112 opposite to the exposed portions where the first surfaces 111 at the end portions of the flat-shaped conductors 110 are exposed to the outside, the reinforcement plates 130 are formed directly on the flat-shaped conductors 110. On the second surfaces 112 opposite to the first surfaces 111 that are in continuous with the exposed portion, the reinforcement plates 130 are formed between the flat-shaped conductors 110 and the second insulating layer 122 on the second surfaces 112. Also, on the second surfaces 112 opposite to the first surfaces 111 in continuous with the exposed portions, the reinforcement plates 130 are directly formed on the flat-shaped conductors 110. Also, the spacer members 134 of the reinforcement plates 130 are provided at positions opposite to the exposed portions.

Next, an example of a method of manufacturing a flat cable according to the present embodiment will be described. Differing from conventional examples as illustrated in FIG. 12 and FIG. 13 in which the reinforcement plates 130 are attached to the outer surface of the insulating layer 120, the flat cable 100 according to the present embodiment has the reinforcement plates 130 provided between the flat-shaped conductors 110 and the second insulating layer 122. Therefore, when the first insulating layer 121 and the second insulating layer 122 are joined to both parallel surfaces of the flat-shaped conductors 110 while heating by heating rollers, the reinforcement plates 130 are also bonded to the flat-shaped conductors 110.

As illustrated in FIG. 2, a plurality of flat-shaped conductors 110 are arranged in parallel, and first insulating layers 121 are provided on the front surface side via a predetermined interval. The flat-shaped conductors 110, located at the portions where the interval is provided, serve as connection terminals as exposed portions. At the end portions of the first insulating layers 121 on the flat-shaped conductors 110 side, adhesive layers 141 are provided in advance. It should be noted that the first insulating layers 121, which are arranged via the interval, are connected to each other by a supporting film (not illustrated) provided on the front surface side thereof (opposite to the flat-shaped conductors 110).

On the back surface side of the parallel surfaces of the flat-shaped conductors 110, second insulating layers 122 are also arranged similarly via an interval at positions corresponding to the locations between which the interval of the first insulating layers 121 on the front surface side is provided. Also, between the parallel surface of the flat-shaped conductors 110 and the second insulating layers 122, a reinforcement plate 130 is arranged to be located at a location where the interval of the second insulating layers 122 is provided. Here, the length of a spacer member 134 of the reinforcement plate 130 in the longitudinal direction (in the X-axis direction) is approximately equal to the length of the interval provided between the second insulating layers 122. As described above, the reinforcement plate 130 has a front surface side adhesive layer 131 and a back surface side adhesive layer 133. The second insulating layers 122 are connected to each other by a supporting film (not illustrated) provided on the back surface side thereof (opposite to the flat-shaped conductors 110). The interval of the first insulating layer 121 on the front surface side corresponds to a first interval L1 of the present disclosure, and the interval of the second insulating layers 122 corresponds to a second interval L2 of the present disclosure. The front surface side adhesive layer 131 is longer than the second interval L2.

Then, the first insulating layers 121, the plurality of flat-shaped conductors 110 in parallel, the reinforcement plate 130, and the second insulating layers 122 are pressed by, for example, heating rollers to be attached together to obtain a flat cable 100.

As a more specific method, the second insulating layers 122 and the reinforcement plates 130 may be attached together in advance to form a tape shape, as illustrated in FIG. 4. In this case, a supporting film for connecting the second insulating layers 122 is not required. Then, between a pair of heating rollers R, the plurality of flat-shaped conductors 110 in parallel are supplied, the first insulating layers 121 connected by a supporting film (not illustrated) on the front surface side of the flat-shaped conductors 110 are supplied, and the tape-shaped member obtained by attaching together the second insulating layers 122 and the reinforcement plate 130 on the back surface side of the flat-shaped conductors 110 is also supplied. As an attachment step, the flat-shaped conductors 110 are sandwiched by the first insulating layers 121 and the second insulating layer 122, and the pair of the first insulating layer 121 and the second insulating layer 122 are attached together to form a long flat cable in which a plurality of flat cables are connected.

Then, at the end portion of the flat cable 100, as illustrated in FIG. 3, for the first insulating layers 121, the adhesive layers 141 are attached to the flat-shaped conductor 110 and a surface adhesive layer of the reinforcement plate. Also, the front surface side of the reinforcement plate 130 is attached to the flat-shaped conductors 110 and the adhesive layers 141 of the first insulating layers 121. Further, the back surface side of the reinforcement plate 130 is attached to the second insulating layers 122. Therefore, a gap does not occur between the flat-shaped conductors 110 and the first insulating layers 121 and the second insulating layers 122.

Next, a division step is performed to divide the long flat cable in which the plurality of flat cables are connected as illustrated in FIG. 4 at the location of the reinforcement plate 130. In the division step, as illustrated in FIG. 3, individual flat cables 100 can be obtained by cutting along the line C-C at the approximate center of the reinforcement plate 130. Thereafter, the flat-shaped conductors 110 exposed at the terminal portion may be gold-plated or a shield layer may be provided to cover the insulating layer 120, as needed. It should be noted that in a case in which a shield layer is provided, a shield layer may be provided in advance on at least one of the first insulating layer 121 and the second insulating layer 122 to be together in the attachment step. Also, before the division step, a shield layer attachment step may be added to attach a shield layer to the surface of the insulating layer 120.

Second Embodiment

Figure 6:
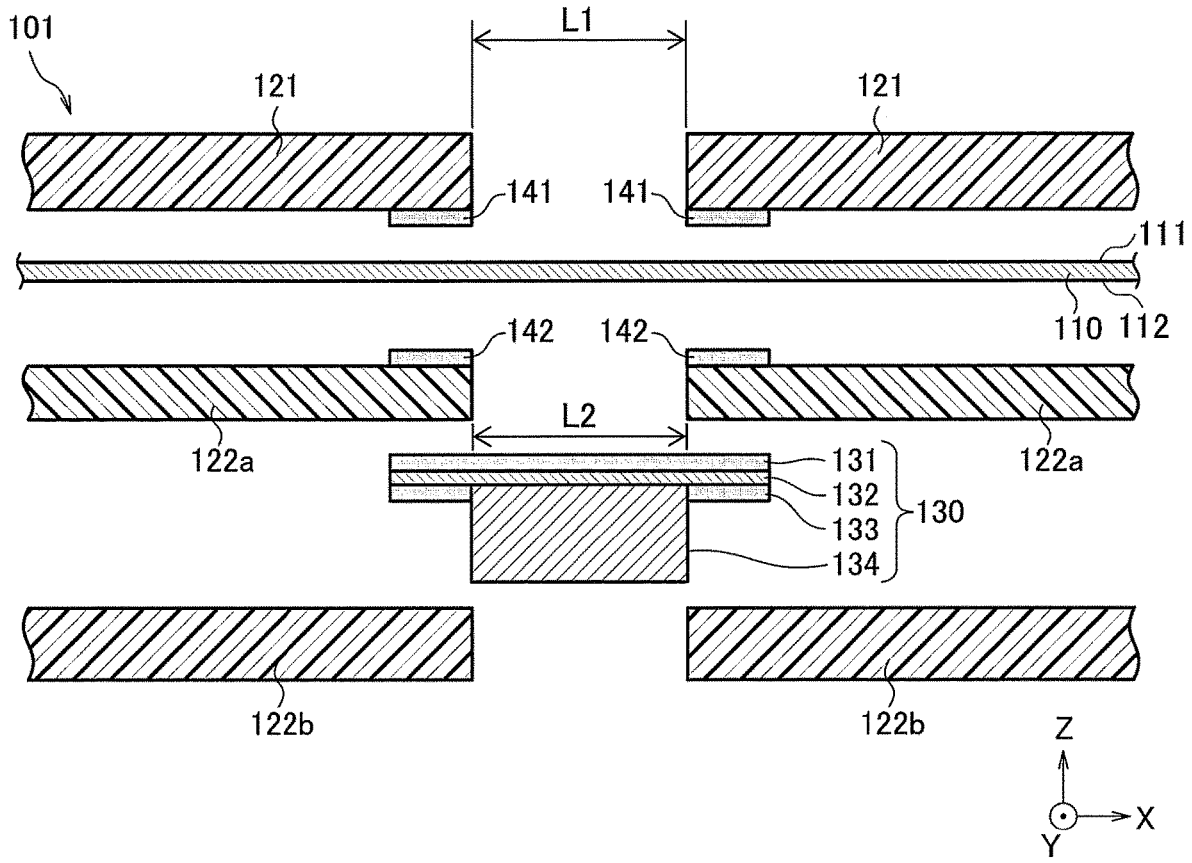
FIG. 6 is a cross-sectional view for describing a method of manufacturing a flat cable according to a second embodiment.
Figure 7:
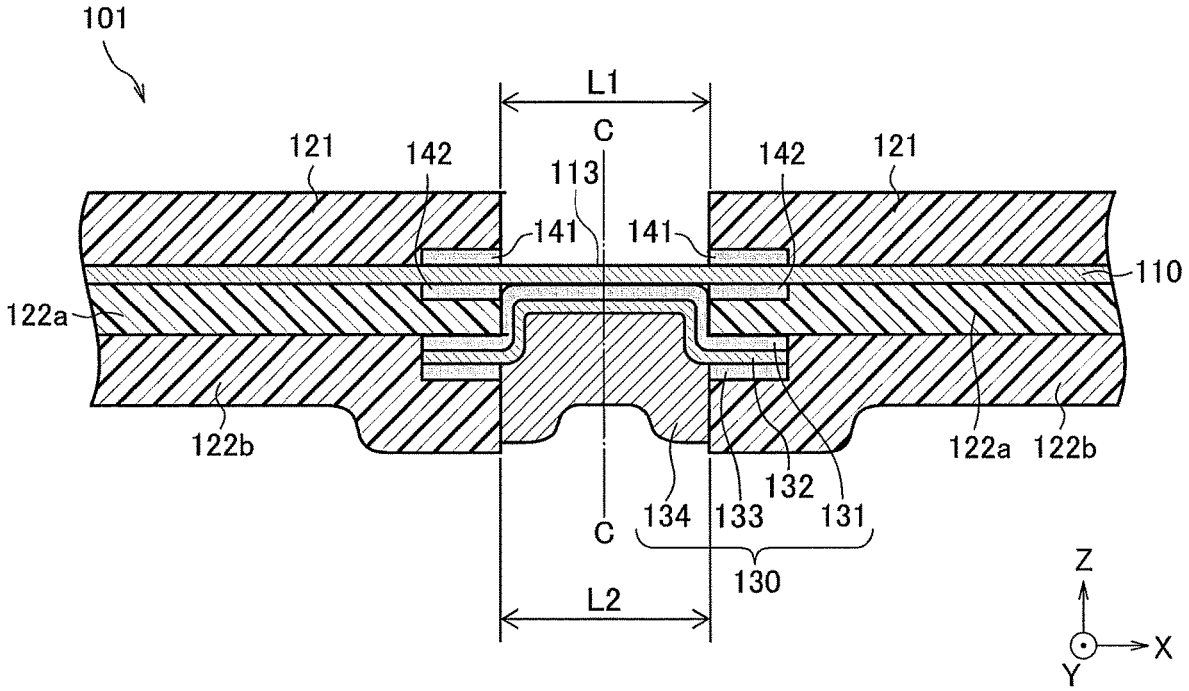
FIG. 7 is a cross-sectional view for describing the method of manufacturing the flat cable according to the second embodiment.
Figure 8:
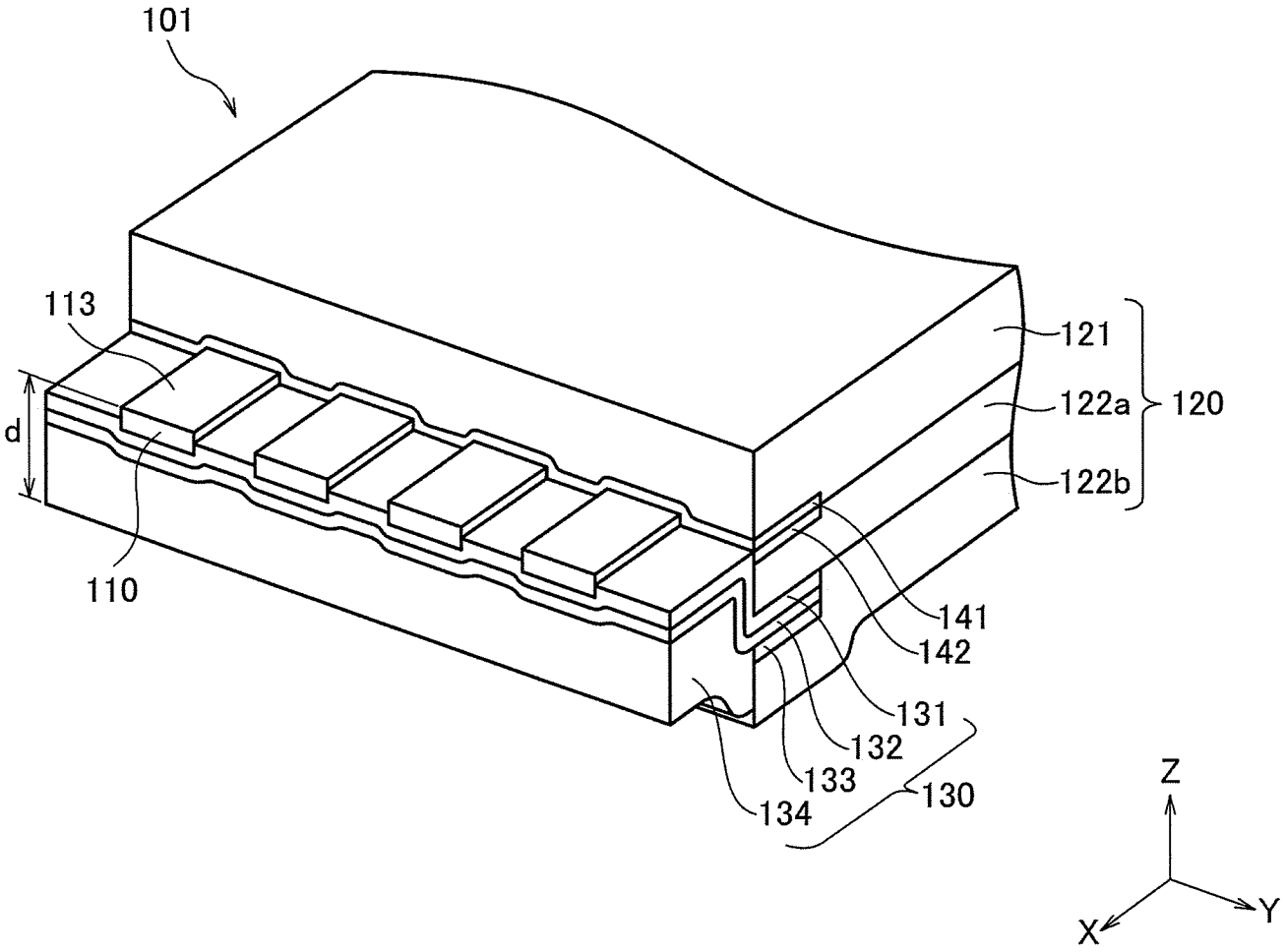
FIG. 8 is a perspective view of a terminal portion of the flat cable according to the second embodiment.

FIG. 6 and FIG. 7 are cross-sectional views for describing a method of manufacturing a flat cable according to a second embodiment, and FIG. 8 is a perspective view of a terminal portion of the flat cable according to the second embodiment. A flat cable 101 according to the second embodiment differs in the configuration of the back surface side of the parallel surfaces of the flat-shaped conductors 110 from the flat cable 100 of the first embodiment.

In the flat cable 101 according to the second embodiment, as illustrated in FIG. 6, a second insulating layer 122 disposed on the back surface side of the parallel surface of the flat-shaped conductors 110 is divided into two portions in the thickness direction as a second insulating layer 122*a* and a third insulating layer 122*b*. Then, a reinforcement plate 130 is arranged between the second insulating layers 122*a* and the third insulating layers 122*b* obtained by division. That is, the reinforcement plate 130 is formed between the second insulating layer 122*a* formed on the flat-shaped conductors 110 and the third insulating layer 122*b* formed on the second insulating layer 122*a*. In the attachment step, the first insulating layers 121, the plurality of flat-shaped conductors 110 in parallel, the reinforcement plate 130, the second insulating layers 122*a*, and the third insulating layers 122*b* are pressed by, for example, heating rollers to be attached together to obtain a flat cable 101. In the second embodiment, the second insulating layers 122*a* are arranged at positions close to the exposed portions at the back surface side of the flat-shaped conductors 110. Therefore, at portions of the second insulating layers 122*a* close to the exposed portions of the flat-shaped conductors 110, the adhesive layers 142 that enhance adhesion to the flat-shaped conductors 110 and the second insulating layers 122*a* are provided.

Because the configuration of the reinforcement plate 130 is similar to that of the first embodiment, the description thereof is omitted. In the present embodiment, according to a configuration in which the first insulating layers 121, the plurality of flat-shaped conductors 110 in parallel, the reinforcement plate 130, the second insulating layers 122*a*, and the third insulating layers 122*b* are attached together, as illustrated in FIG. 7, an end portion of the reinforcement plate 130 in the longitudinal direction (X-axis direction) is sandwiched by the second insulating layers 122*a* and the third insulating layers 122*b*, and the end portion of the reinforcement plate 130 can be separated from the flat-shaped conductors 110.

In the present embodiment, similar to the first embodiment, by preparing a flat cable in which a plurality of flat cables 101 are connected and by cutting along the line C-C at the approximate center of the reinforcement plate 130, individual flat cables 100 each having a terminal portion illustrated in FIG. 8 can be obtained Thereafter, the flat-shaped conductors 110 exposed at the terminal portion may be gold-plated or a shield layer may be provided to cover the insulating layer 120, as needed. It should be noted that in the present embodiment, similar to the first embodiment, the thickness d of the terminal portion can be adjusted by changing the thickness of the spacer member 134.

Third Embodiment

Figure 9:
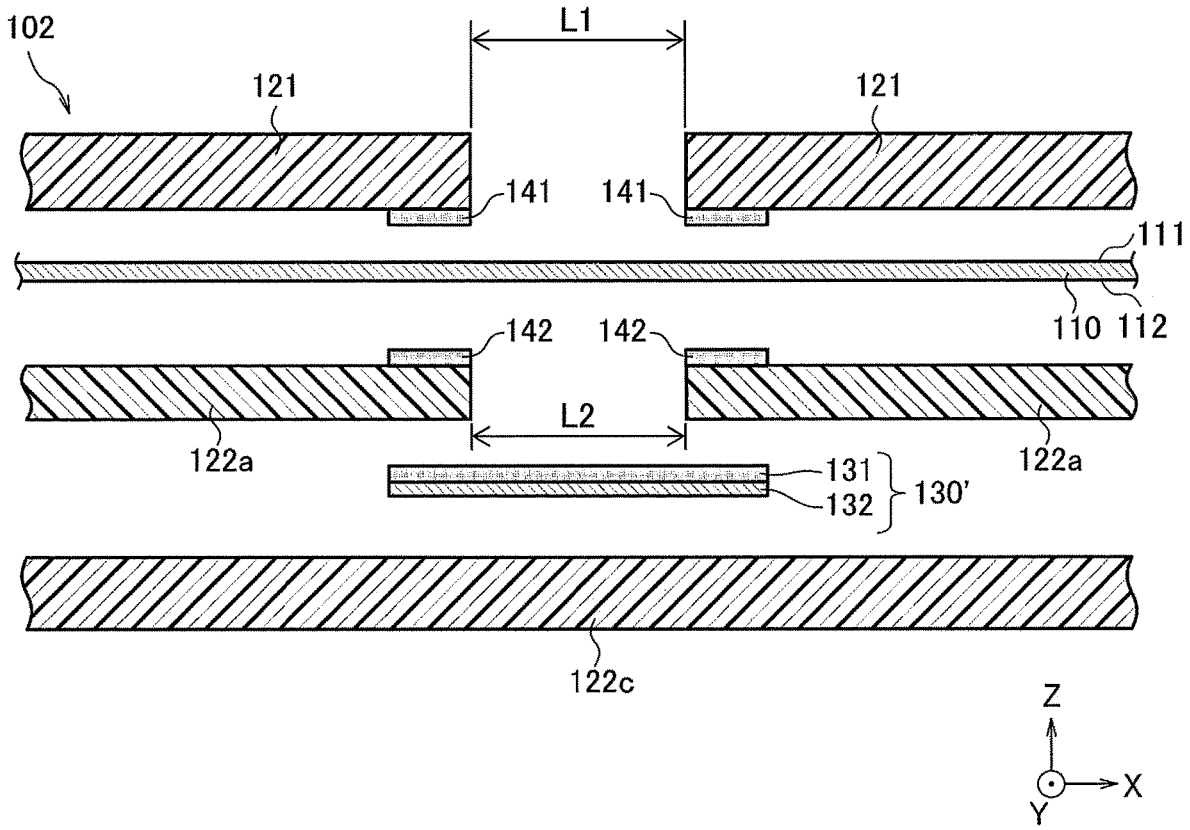
FIG. 9 is a cross-sectional view for describing a method of manufacturing a flat cable according to a third embodiment.
Figure 10:
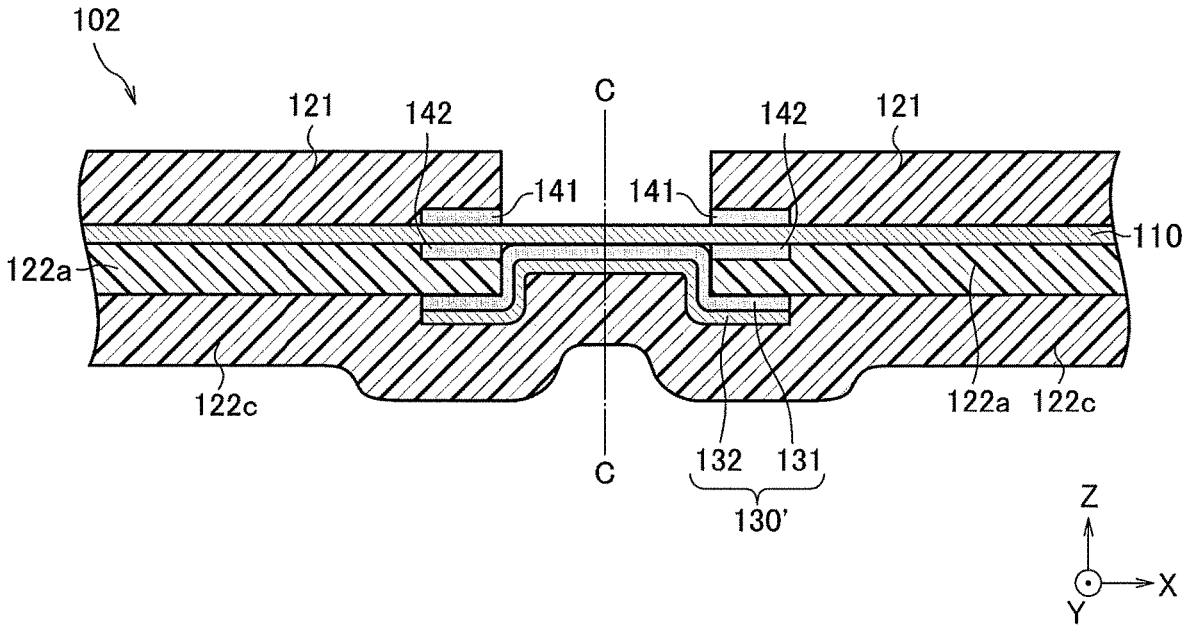
FIG. 10 is a cross-sectional view for describing the method of manufacturing the flat cable according to the third embodiment.
Figure 11:
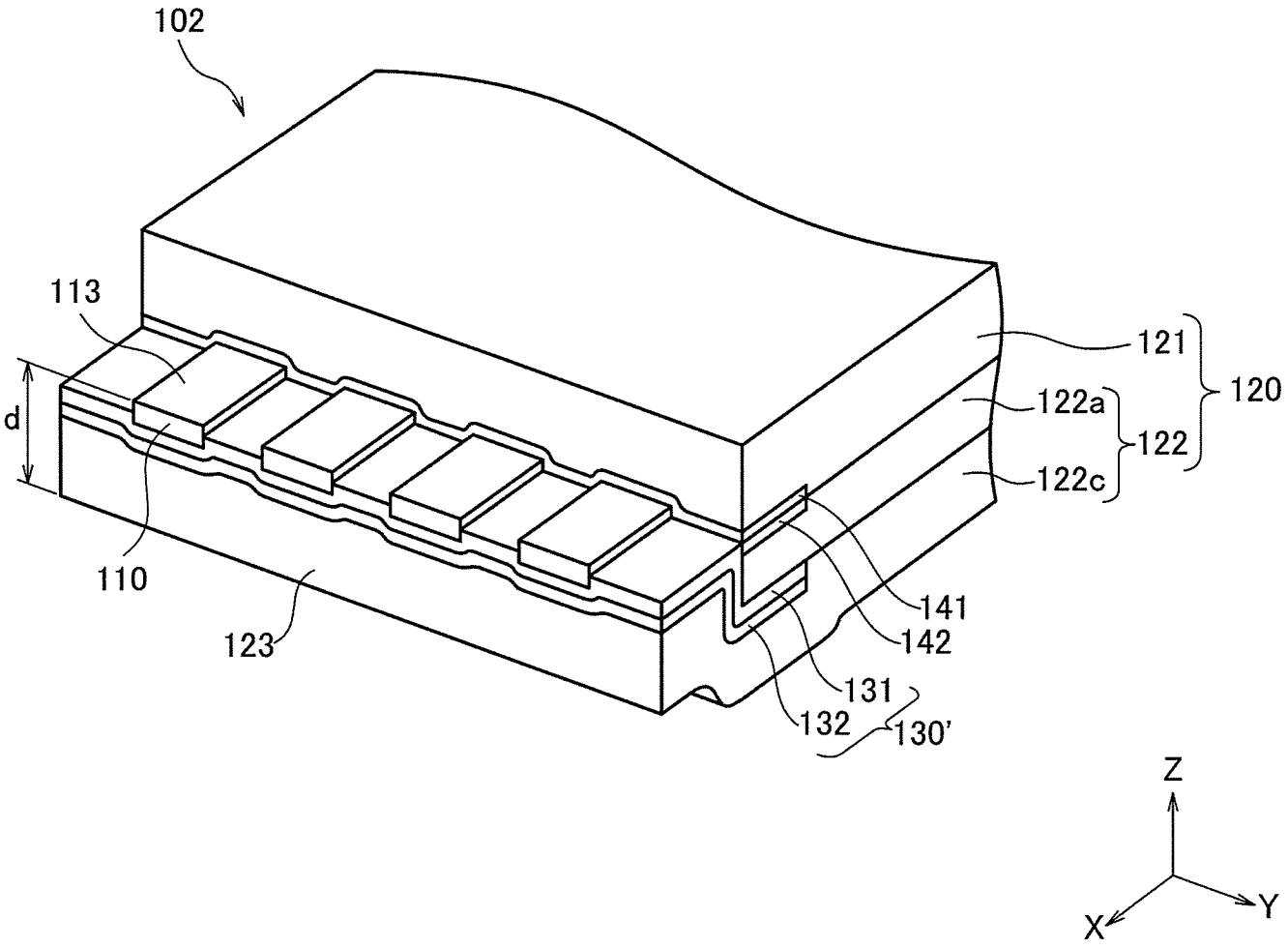
FIG. 11 is a perspective view of a terminal portion of the flat cable according to the third embodiment.

FIG. 9 and FIG. 10 are cross-sectional views for describing a method of manufacturing a flat cable according to a third embodiment, and FIG. 11 is a perspective view of a terminal portion of the flat cable according to the third embodiment. A flat cable 102 according to the third embodiment differs in the configuration of the back surface side of the parallel surfaces of the flat-shaped conductors 110 from the flat cable 100 of the first embodiment and the flat cable of the second embodiment.

In the flat cable 102 according to the third embodiment, as illustrated in FIG. 9, a second insulating layer 122 disposed on the back surface side of the parallel surface of the flat-shaped conductors 110 is divided into two portions in the thickness direction as a second insulating layer 122*a* and a third insulating layer 122*c*. Here, the third insulating layer 122*c* on the farther side from the flat-shaped conductors 110 is an insulating layer that is continuous without an interval. Then, a reinforcement plate 130' is arranged between the second insulating layers 122*a* and the third insulating layer 122*c* obtained by division. In a cross-section along the longitudinal direction of the flat-shaped conductors 110, the third insulating layer 122*c* covers the entire surface that is the opposite surface of the surface of the reinforcement plate 130 facing the flat-shaped conductors 110. Here, the reinforcement plate 130' has a front surface side adhesive layer 131 on the entire surface of the front surface side of a resin layer 132, and does not have a spacer member 134, differing from the reinforcement plates 130 used in the first and second embodiments.

Then, in the attachment step, the first insulating layers 121, the plurality of flat-shaped conductors 110 in parallel, the reinforcement plate 130', the second insulating layers 122*a*, and the third insulating layer 122*c* are pressed by, for example, heating rollers to be attached together to obtain a flat cable 102. In the third embodiment, similar to the second embodiment, the second insulating layers 122*a* are arranged at positions close to the exposed portions at the back surface side of the flat-shaped conductors 110. Therefore, at portions on the second insulating layers 122*a* close to the exposed portions of the flat-shaped conductors 110, the adhesive layers 142 of material favorable in adhesion to the flat-shaped conductors 110 and the insulating layer 120 are provided.

In the present embodiment, according to a configuration in which the first insulating layers 121, the plurality of flat-shaped conductors 110 in parallel, the reinforcement plate 130, the second insulating layers 122*a*, and the third insulating layer 122*c* are attached together, as illustrated in FIG. 10, an end portion of the reinforcement plate 130 in the longitudinal direction (X axis direction) is sandwiched by the second insulating layers 122*a* and the third insulating layer 122*c*, and the end portion of the reinforcement plate 130 can be separated from the flat-shaped conductors 110.

In the present embodiment, similar to the first embodiment, by preparing a flat cable in which a plurality of flat cables 101 are connected and by cutting along the line C-C at the approximate center of the reinforcement plate 130, individual flat cables 102 each having a terminal portion illustrated in FIG. 11 can be obtained Thereafter, the flat-shaped conductors 110 exposed at the terminal portion may be gold-plated or a shield layer may be provided to cover the insulating layer 120, as needed.

DESCRIPTION OF THE REFERENCE NUMERALS

100, 101, 102 flat cable
110 flat-shaped conductor
111 first surface
112 second surface
113 exposed surface
120 insulating layer
121 first insulating layer,
122, 122*a* second insulating layer
122*b*, 122*c* third insulating layer
130, 130' reinforcement plate
131 front surface side adhesive layer
132 resin layer
133 back surface side adhesive layer
134 spacer member,
141, 142 adhesive layer
150 shield layer
L1 first interval
L2 second interval

The invention claimed is:

1. A flat cable comprising:

a plurality of conductors arranged in parallel;

an insulating layer formed, on first surfaces of the plurality of conductors and on second surfaces that are opposite surfaces of the first surfaces, along the plurality of conductors;

an exposed portion where the first surfaces at end portions of the conductors are exposed to outside; and a reinforcement plate formed on the second surfaces opposite to the exposed portion, wherein on the second surfaces opposite to the exposed portion, the reinforcement plate is directly formed on the conductors, and on the second surfaces opposite to the first surfaces that are in continuous with the exposed portion, wherein the insulating layer includes a first insulating layer that is provided in contact with the conductors on the first surfaces and includes a second insulating layer that is provided in contact with the conductors on the second surfaces and that is opposite to the first insulating layer, wherein the reinforcement plate is formed between the first insulating layer and the second insulating layer, wherein the reinforcement plate includes, in an order of proximity to the conductors, a resin layer and a spacer member provided in contact with the resin layer, wherein the resin layer is provided to be interposed between the conductors and the spacer member at the exposed portion, wherein the resin layer is provided to be interposed between the conductors and the second insulating layer at a portion overlapping with the first insulating layer, and wherein an end surface of the spacer member perpendicular to the second surfaces is provided to face an end surface of the second insulating layer perpendicular to the second surfaces.

2. The flat cable according to claim 1, wherein the reinforcement plate includes a spacer at a position opposite to the exposed portion.

3. The flat cable according to claim 1, further comprising:

a shield layer that covers the insulating layer.

4. A method of manufacturing the flat cable according to claim 1, the method comprising:

an attachment step of attaching, to the conductors, the first insulating layer arranged via a first interval on the first surfaces, the second insulating layer arranged via a second interval on the second surfaces at locations corresponding to locations via the first interval; and the reinforcement plate that is longer than the second interval; and a division step of dividing the reinforcement plate in a longitudinal direction of the conductors.

5. The method of manufacturing the flat cable according to claim 4, wherein in the attachment step, the reinforcement plate is attached to the second insulating layer and a third insulating layer is arranged on the reinforcement plate on the second insulating layer.

6. The method of manufacturing the flat cable according to claim 5, wherein the third insulating layer entirely covers the reinforcement plate.

7. The method of manufacturing the flat cable according to claim 4, wherein the reinforcement plate includes the spacer member on a surface that is an opposite surface of a surface that is attached to the conductors at a position where the second interval is provided.

8. The method of manufacturing the flat cable according to claim 4, wherein on a surface of the reinforcement plate facing the conductors, and a surface at an end potion of the first insulating layer in contact with the first interval and facing the conductors, adhesive layers are provided in advance.

9. The method of manufacturing the flat cable according to claim 4, further comprising:

a plating step of applying gold-plating to the exposed portion of the conductors.

10. A flat cable comprising:

a plurality of conductors arranged in parallel;

an insulating layer formed, on first surfaces of the plurality of conductors and on second surfaces that are opposite surfaces of the first surfaces, along the plurality of conductors;

an exposed portion where the first surfaces at end portions of the conductors are exposed to outside; and a reinforcement plate formed on the second surfaces opposite to the exposed portion, wherein on the second surfaces opposite to the exposed portion, the reinforcement plate is directly formed on the conductors, and on the second surfaces opposite to the first surfaces that are in continuous with the exposed portion, wherein on the second surfaces opposite to the first surfaces that are in continuous with the exposed portion, the insulating layer includes a second insulating layer formed on the conductors and a third insulating layer formed on the second insulating layer and the reinforcement plate is formed between the second insulating layer and the third insulating layer, wherein the insulating layer includes a first insulating layer that is provided in contact with the conductors on the first surfaces, wherein the reinforcement plate includes, in an order of proximity to the conductors, a resin layer and a spacer member provided in contact with the resin layer, wherein the resin layer is provided to be interposed between the conductors and the spacer member at the exposed portion, wherein the resin layer is provided to be interposed between the second insulating layer and the third insulating layer at a portion overlapping with the first insulating layer, and wherein an end surface of the spacer member perpendicular to the second surfaces is provided to face an end surface of the third insulating layer perpendicular to the second surfaces.

11. The flat cable according to claim 10, wherein in a cross-section along a longitudinal direction of the conductors, the third insulating layer covers an entire surface that is an opposite surface of a surface of the reinforcement plate facing the conductors.

12. The flat cable according to claim 10, wherein the reinforcement plate includes a spacer at a position opposite to the exposed portion.

13. The flat cable according to claim 10, further comprising:

a shield layer that covers the insulating layer.

* * * * *